US006157289A

United States Patent [19]

Kojima et al.

[11] Patent Number: 6,157,289

[45] Date of Patent: Dec. 5, 2000

[54] PTC THERMISTOR

[75] Inventors: Junji Kojima, Hirakata; Kohichi Morimoto, Sakai; Takashi Ikeda; Naohiro Mikamoto, both of Osaka, all of Japan

[73] Assignee: Mitsushita Electric Industrial Co., Ltd., Osaka, Japan

[21] Appl. No.: 09/147,790

[22] PCT Filed: Sep. 22, 1997

[86] PCT No.: PCT/JP97/03357

§ 371 Date: Mar. 9, 1999

§ 102(e) Date: Mar. 9, 1999

[87] PCT Pub. No.: WO98/12715

PCT Pub. Date: Mar. 26, 1998

[30] Foreign Application Priority Data

Sep. 20, 1995 [JP] Japan ..... 8-249515

[51] Int. Cl.[7] ..... H01C 7/10

[52] U.S. Cl. ..... 338/22 R; 338/328; 338/331; 338/332

[58] Field of Search ..... 338/22 R, 225 D, 338/328, 331, 332; 29/610.1, 621

[56] References Cited

U.S. PATENT DOCUMENTS

| | | | |
|---|---|---|---|
| 4,689,475 | 8/1987 | Kleiner et al. | 219/553 |
| 5,245,309 | 9/1993 | Kawase et al. | 338/22 R |
| 5,488,348 | 1/1996 | Asida et al. | 338/22 R |
| 5,493,266 | 2/1996 | Sasaki et al. | 338/22 R |
| 5,500,996 | 3/1996 | Fritsch et al. | 29/612 |
| 5,831,510 | 11/1998 | Zhang et al. | 338/22 R |
| 5,874,885 | 2/1999 | Chandler et al. | 338/22 R |

FOREIGN PATENT DOCUMENTS

| | | | |
|---|---|---|---|
| 0 229 286 | 7/1987 | European Pat. Off. . | |
| 5299201 | 11/1993 | Japan | 338/22 R |
| 95 08176 | 3/1995 | WIPO . | |
| 95 34081 | 12/1995 | WIPO . | |

OTHER PUBLICATIONS

Patent Abstracts of Japan, vol. 016, No. 154 (E–1190) Apr. 15, 1992 (Apr. 15, 1992) & JP 04 007802 A (Daito Tsushinki KK), Jan. 13, 1992 (Jan. 13, 1992) (abstract).

*Primary Examiner*—Karl D. Easthom
*Attorney, Agent, or Firm*—McDermott, Will & Emery

[57] ABSTRACT

The invention presents a PTC thermistor which is high in adhesive strengths of inner- and outer-layer electrodes composed of metallic foil respectively stuck to conductive sheets, and has a larger current breaking characteristic. It contains a laminated body (13) which is formed by alternately laminating a plurality of conductive sheets (14) and an inner-layer electrode (11) composed of metallic foil having first plated layers (12) so that the conductive sheets (14) can become the outermost layers, an outer-layer electrode (18) positioned at the outermost layer of the laminated body (13), and having a second plated layer (16) on a side facing the inner-layer electrode (11), and side-face electrode layers 20) disposed at facing sides of the laminated body 913) for connecting electrically the inner-layer electrode (11) and outer-layer electrode (18).

19 Claims, 9 Drawing Sheets

PTC THERMISTOR

TECHNICAL FIELD

The present invention relates to a positive temperature coefficient (PTC) thermistor using a conductive polymer having a PTC characteristic.

BACKGROUND ART

A conventional PTC thermistor is described below.

A conventional PTC thermistor is disclosed, for example, in Japanese Laid-open Patent No. 61-10203, in which a plurality of conductive sheets composed of polymer having PTC characteristic, and an inner-layer electrode and an outer-layer electrode composed of metallic foil are alternately laminated, and a side-face electrode layer is disposed at a facing side as a lead-out part.

FIG. 7 is a sectional view of a conventional PTC thermistor.

In FIG. 7, reference numeral is a conductive sheet having carbon black or other conductive particles mixed in a crosslinked polyethylene or other polymer material. Reference numeral 2 is a metallic foil of copper, nickel or the like, having openings 3 disposed at the start end and terminal end of the conductive sheet 1 and crimped alternately, and disposed at upper and lower sides of the conductive sheet 1, and an inner-layer electrode 2*a* and outer-layer electrode 2*b* composed of this metallic foil 2 and the conductive sheet 1 are laminated alternately to form a laminated body. Reference numeral 5 is a side-face electrode layer disposed to be connected electrically with an end of the inner-layer electrode 2*a* and outer-layer electrode 2*b* at the side facing the laminated body 4.

In thus constituted conventional PTC thermistor, its manufacturing method is described below.

First, carbon black or other conductive particles are mixed in polyethylene, and a rectangular conductive sheet 1 is formed, and an inner-layer electrode 2*a* and an outer-layer electrode 2*b* composed of a metallic foil made of copper or nickel, of which side is shorter than at least one side of the sides of the conductive sheet 1 by 0.5 to 3.0 mm, are laminated, so that one end is alternately aligned with one end of the conductive sheet 1 and that an opening 3 may be formed at other end, so that a laminated body 4 is formed. At this time, the uppermost side and lowermost side of the laminated body 4 are formed so that the outer-layer electrode 2*b* composed of metallic foil may be laminated.

Next, while heating the laminated body 4 to a temperature of 100 to 200 deg. C., it is compressed from above and beneath, the conductive sheet 1 is softened, and the conductive sheet 1 of the laminated body 4 and the inner-layer electrode 2*a* and outer-layer electrode 2*b* made of metallic foil are fixed.

Finally, at the facing side of the laminated body 4 fixed in the preceding step, a conductive paste is applied to connect electrically with an end of the inner-layer electrode 2*a* and outer-layer electrode 2*b* composed of metallic foil 2, and a side-face electrode 5 is formed, and then by crosslinking, a PTC thermistor is manufactured.

In such conventional PTC thermistor constitution, however, in order to lower the initial resistance value, the conductive sheet 1 and the inner-layer electrode 2*a* and outer-layer electrode 2*b* composed of metallic foil are laminated alternately and compressed thermally, but since they are made of different materials, when exposed to thermal impulse, peeling may occur between the conductive sheet 1 and the inner electrode layer 2*a* and outer electrode layer 2*b* made of metallic foil due to large difference in coefficient of thermal expansion, thereby increasing the resistance value. Further, in a conventional PTC thermistor as shown in FIG. 7, when bonding a PTC thermistor to a printed board by soldering, the solder is not bonded sufficiently to the side-face electrode 5 or outer-layer electrode 2*b*. As a result, defective connection occurs, and the soldered portion may be cracked by thermal impulse of high temperature and low temperature.

It is hence an object of the invention to present a PTC thermistor excellent in contact between the conductive sheet and inner-layer electrode and outer-layer electrode composed of metallic foil, and not increasing in the resistance value due to thermal impulse.

SUMMARY OF THE INVENTION

To achieve the object, the PTC thermistor of the invention is characterized by composing an inner-layer electrode of a metallic foil with a rough surface by forming a first plated layer on both sides, and composing an outer-layer electrode of a metallic foil with a rough surface by forming a second plated layer on a surface facing a conductive sheet.

BRIEF DESCRIPTION OF THE DRAWINGS

FIG. 1 (*b*) is a sectional view of 1(*b*)—1(*b*) of the PTC thermistor of FIG. 1 (*a*).

DETAILED DESCRIPTION OF THE INVENTION

Figure 1A:
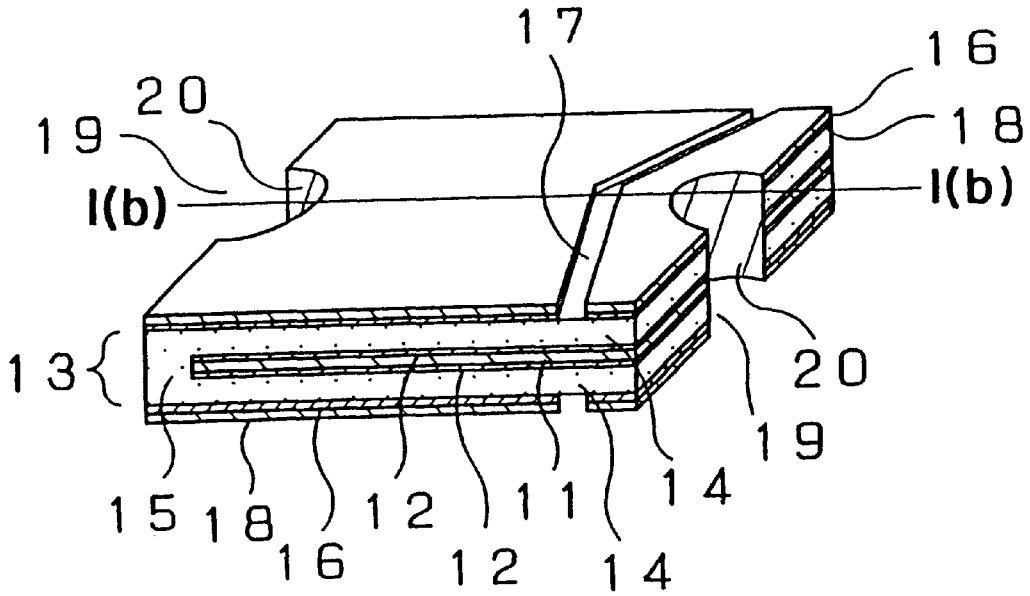
FIG. 1 (*a*) is a perspective view of a PTC thermistor in a first embodiment of the invention.

The invention as set forth in a first exemplary embodiment of the invention relates to a PTC thermistor comprising:

a laminated body containing at least two layers of conductive sheet composed of a polymer having a PTC characteristic and at least one layer of inner-layer electrode composed of a metallic foil having first plated layers on both surfaces, formed by alternately laminating a plurality of layers so that the inner-layer electrode may have a free space at the side end portion and that the outermost layer may become the conductive sheet, an outer-layer electrode disposed at a side facing the inner-layer electrode of the conductive sheet positioned at the outermost layer of the laminated body, having a free space in part, and having a second plated layer on a side facing the conductive sheet, and side-face electrode layers disposed at facing sides of the laminated body for connecting electrically the inner-layer electrode and outer-layer electrode.

The invention as set forth in a second exemplary embodiment of the invention relates to a PTC thermistor of the first exemplary embodiment described above, in which the conductive sheet contains three layers or more, and the inner-layer electrode contains two layers or more, and both have a free space so as to be aligned alternately at side end portions.

The invention as set forth in a third exemplary embodiment of the invention relates to a PTC thermistor of the first exemplary embodiment described above, in which the inner-layer electrode and outer-layer electrode are nickel-plated copper foils.

The invention as set forth in a forth exemplary embodiment of the invention relates to a PTC thermistor of the first exemplary embodiment described above, in which the side-face electrode layers are composed of a same metallic material as the inner-layer electrode and outer-layer electrode.

The invention as set forth in a fifth exemplary embodiment of the invention relates to a PTC thermistor of the first exemplary embodiment described above, in which the laminated body has recesses at its facing sides, and the side-face electrode layers are provided in the recesses only.

EMBODIMENTS

Referring now to the drawings, embodiments of PTC thermistor of the invention are described below.

Figure 1B:
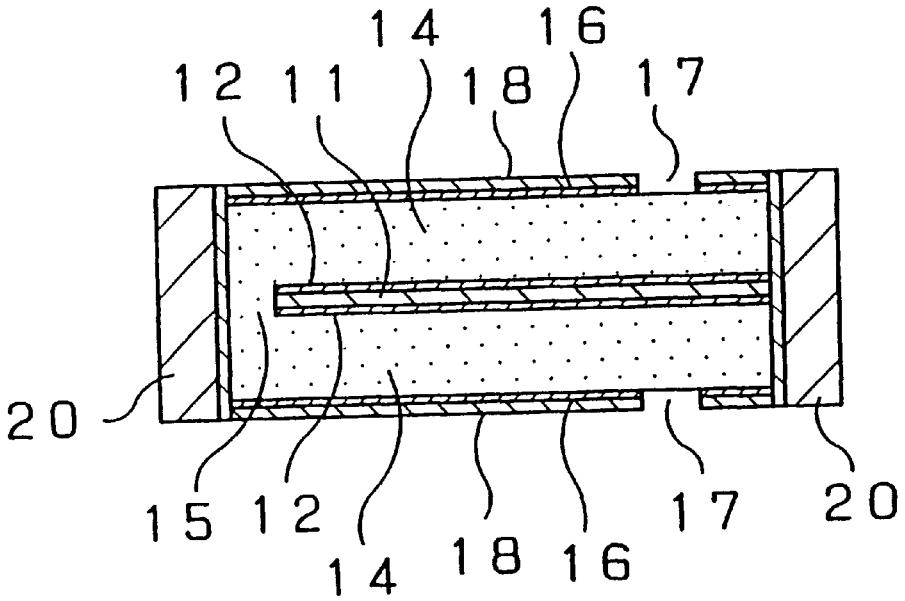
Figure 2A:
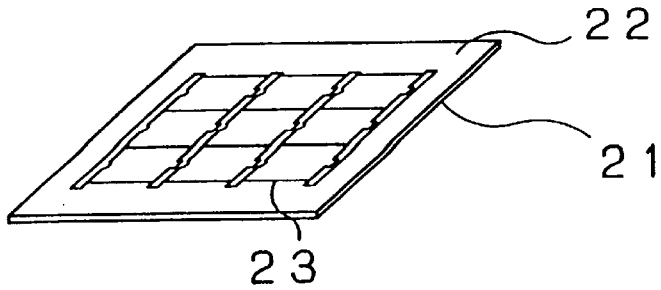
FIGS. 2 (*a*)–(*d*) and FIGS. 3 (*a*)–(*d*) depict method steps for manufacturing thermistors such as the thermistor as depicted in FIG. 1 (*a*).
Figure 2B:
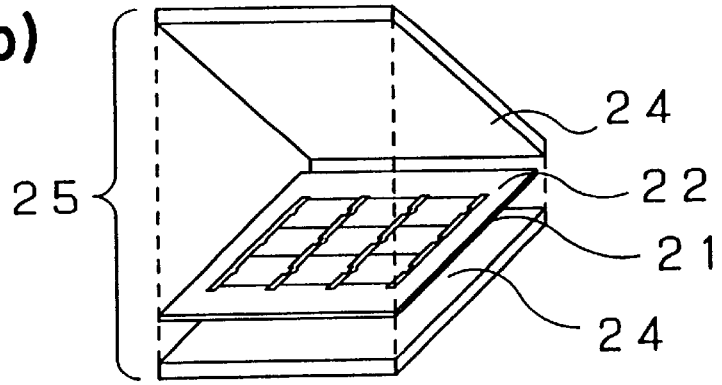
Figure 2C:
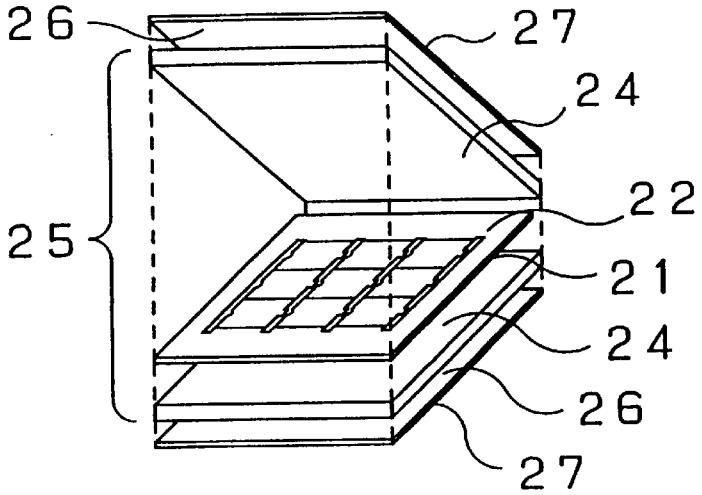
Figure 2D:
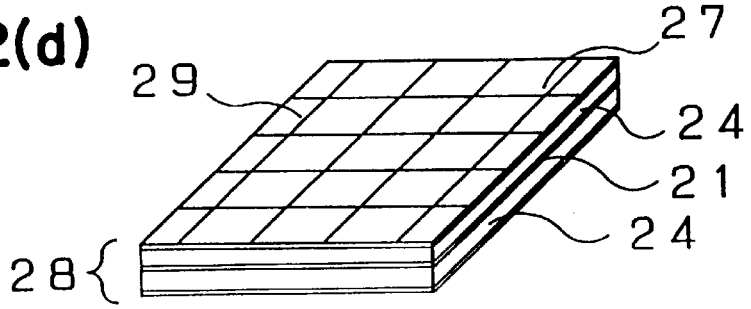
Figure 3A:
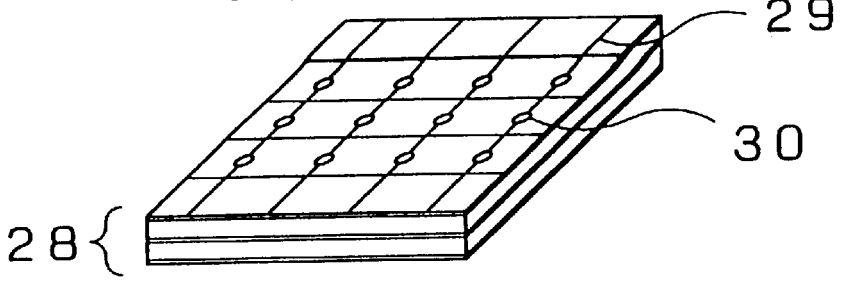
Figure 3B:
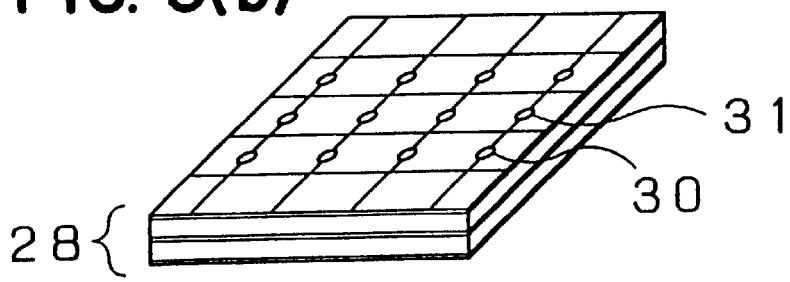
Figure 3C:
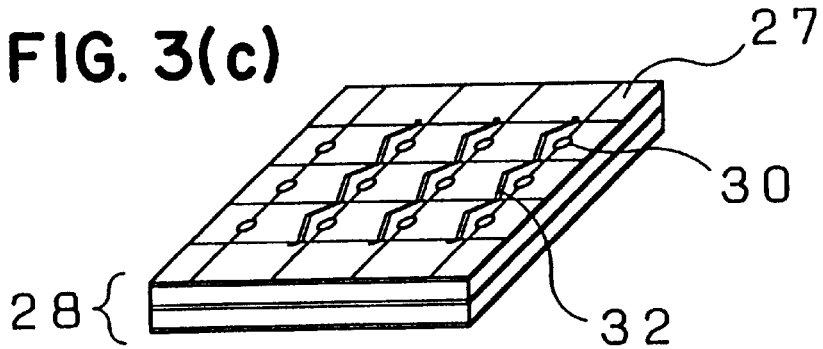
Figure 3D:
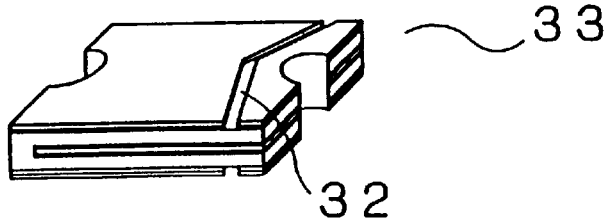

FIG. 1 (*a*) is a perspective view of a PTC thermistor in a first embodiment of the invention, and FIG. 1 (*b*) is its sectional view of 1(*b*)—1(*b*).

In FIG. 1, reference numeral 11 is an inner-layer electrode composed of a metallic foil such as electrolytic copper foil having first plated layers 12 made of nickel or the like on upper and lower surfaces.

Reference numeral 13 is a laminated body which is formed by alternately laminating the inner-layer electrode 11, and a conductive sheet 14 formed by mixing crystalline polymer composed of high density polyethylene or the like and conductive particles composed of carbon black or the like, so that the outermost layer may be the conductive sheet 14, and there is a free space 15 at the side end portion of the inner-layer electrode 11 composed of metallic foil.

Reference numeral 18 is an outer-layer electrode composed of a metallic foil such as electrolytic copper foil forming a second plated layer 16 having a free space 17 in part, disposed at a side facing the inner-layer electrode 11 composed of metallic foil of the conductive sheet 14 positioned in the outermost layer of the laminated body 13, and it is laminated so that the second plated layer 16 may face the conductive sheet 14. Reference numeral 19 is a recess provided at the side facing the laminated body 13. Reference numeral 20 shows side-face electrode layers composed of a same material as the inner-layer electrode 11, disposed in facing side recesses 19 of the laminated body 13, for connecting electrically the inner-layer electrode 11 and outer-layer electrode 18.

In thus constituted PTC thermistor of the first embodiment of the invention, its manufacturing method is described below while referring to the drawings.

FIG. 2 and FIG. 3 are process charts showing the manufacturing method of the PTC thermistor in the first embodiment of the invention.

First, as shown in FIG. 2 (*a*), first plated layers 22 of nickel or other metal are formed on the entire area of both upper and lower surfaces of an inner-layer electrode 21 composed of metallic foil such as electrolytic copper foil, by electroless plating method or the like, and the upper and lower surfaces are roughened by 2 microns or more. At this time, in order to cut into pieces in a later process, splitting grooves 23 may be formed in the inner-layer electrode 21 composed of metallic foil by using die press, etching method or the like, or the inner-layer electrode 21 composed of metallic foil preliminarily forming splitting grooves 23 may be used.

Consequently, as shown in FIG. 2 (*b*), a conductive sheet 24 composed of a mixture of about 56 wt. % of crystalline polymer composed of high density polyethylene or the like with the degree of crystallization of about 70 to 90%, and about 44 wt. % of conductive particles composed of carbon black or the like with mean particle size of about 58 nm and specific surface area of about 38 $m^2/g$ is laminated in the upper and lower surfaces of the inner-layer electrode 21 composed of a metallic foil having the upper and lower surfaces roughened by the first plated layers 22 by 2 microns or more, thereby forming a laminated body 25.

Then, as shown in FIG. 2 (*c*), an outer-layer electrode 27 having one surface roughed by forming a second plated layer 26 of nickel or other metal on one side of a metal of electrolytic copper foil or the like is laminated on the outermost layer of the obtained laminated body 25, so that the roughened surface may contact with the conductive sheet 24.

Next, as shown in FIG. 2 (*d*), the laminated body 25 laminating the outer-layer electrode 27 obtained in the preceding step is pressed and formed while heating for about 1 minute at a pressure of degree of vacuum of about 20 Torr and surface pressure of about 50 $kg/cm^2$, by using a hot plate of about 175 deg. C. higher than the melting point of the polymer by about 40 deg. C., and a laminated sheet 28 is formed. At this time, in order to cut into pieces in a later process, splitting grooves 29 may be formed in the outer-layer electrode 27 by using die press, etching method or the like, or the outer-layer electrode 27 composed of metallic foil preliminarily forming splitting grooves 29 may be used.

Successively, as shown in FIG. 3 (*a*), through-holes 30 are formed by drilling machine, die press or the like on the upper surface of the splitting grooves 29 of the laminated sheet 28.

As shown in FIG. 3 (*b*), at least the inner wall of the through-hole 30 is plated with copper in a thickness of 25 to 30 microns by electrolytic copper plating or electroless copper plating, and a side-face electrode layer 31 is formed. At this time, the plating applied in the inner wall of the through-hole 30 may be formed to cover around the through-hole 30, or the upper surface and lower surface of the laminated sheet 28.

Then, as shown in FIG. 3 (*c*), a resist is formed on the upper surface of the outer-layer electrode 27 which coincides with the outermost layer of the laminated sheet 28 by screen printing or photographic method, and the resist is removed by chemical etching, using iron chloride, and a free space 32 is formed.

Finally, as shown in FIG. 3 (*d*), by dicing the laminated sheet 28 along the splitting grooves 29, or by cutting into individual pieces 33 by die press, a PTC thermistor is manufactured.

Herein, the relation between the contact of the conductive sheet 24 with the inner-layer electrode 21 and outer-layer electrode 27, and the surface pressure when pressurizing is described below.

Figure 4:
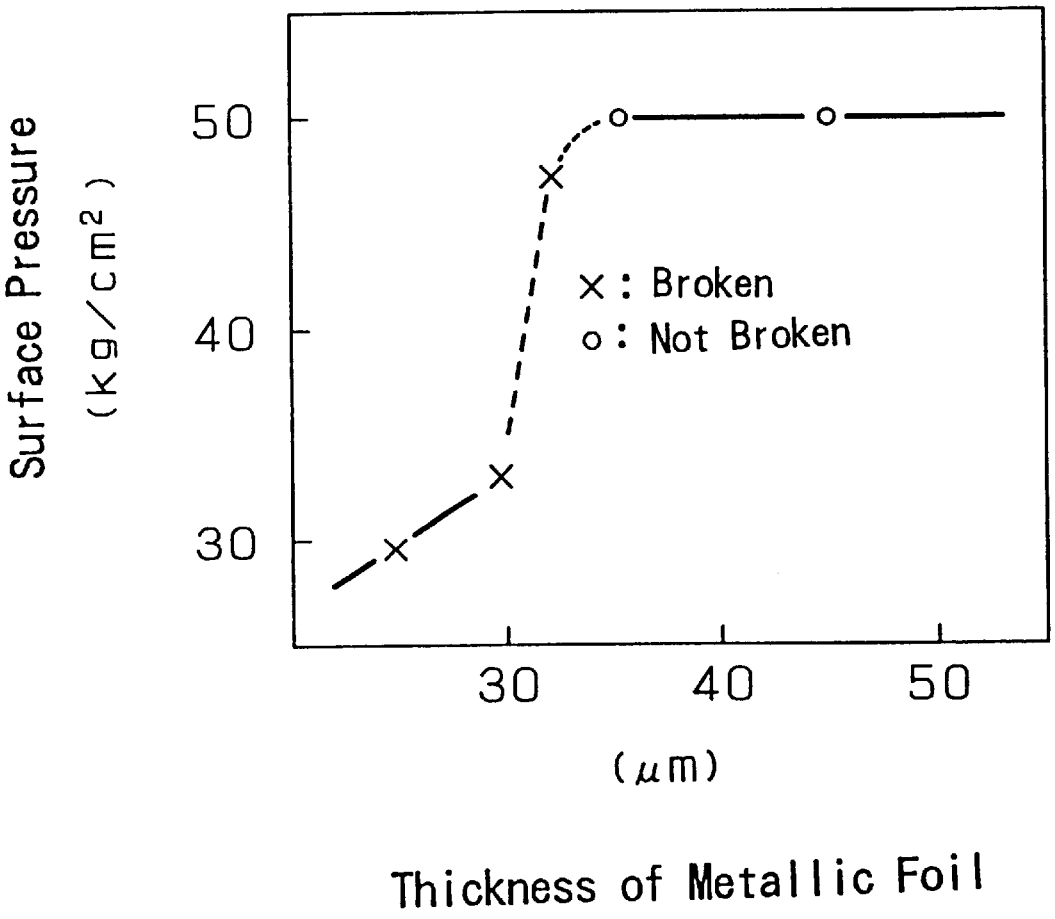
FIG. 4 is a characteristic curve showing the breakdown characteristic of the metallic foil used in the PTC thermistor.

To enhance the contact of the conductive sheet 24 with the inner-layer electrode 21 and outer-layer electrode 27, when pressurizing while heating, it is required to apply a pressure of surface pressure of about 50 kg/cm$^2$ or more. Considering the relation with the thickness of the inner-layer electrode 21 and outer-layer electrode 27, when pressurized, the conductive sheet 24 Is melted and tends to expand in the surface direction, and also by the frictional force of the of the conductive sheet 24 against the inner-layer electrode 21 and outer-layer electrode 27, a tensile stress is generated in the surface direction in the inner-layer electrode 21 and outer-layer electrode 27, and the inner-layer electrode 21 and outer-layer electrode 27 may be broken it their metallic foil is thin. FIG. 4 shows the data comparing presence and absence of breakage of the metallic foil in relation to the force applied in this surface direction (surface pressure) and the thickness of the metallic foil. In FIG. 4, the PTC thermistor in the first embodiment of the invention was crimped by hot plates heated to about 175 deg. C. from above and beneath the outer-layer electrode 27, and a pressure was applied by a press machine, then releasing from the press machine, X-ray was emitted from above the outer-layer electrode 27 to inspect for presence or absence of breakage of metallic foil as the inner-layer electrode 21 of the inside. Herein, since only one side of the outer-layer electrode 27 contacts with the conductive sheet, its chance of breakage due to surface pressure is lower as compared with the inner-layer electrode 21.

In FIG. 4, if the thickness of the metallic foil is less than 35 microns, it is already broken at surface pressure of less than 50 kg/cm$^2$, and a pressure of 50 kg/cm$^2$ necessary for obtaining contact cannot be applied. Therefore, to achieve contact without breakage of metallic foil if a pressure of 50 kg/cm$^2$ is applied, it is known that a thickness of 35 microns or more is needed.

Figure 5:
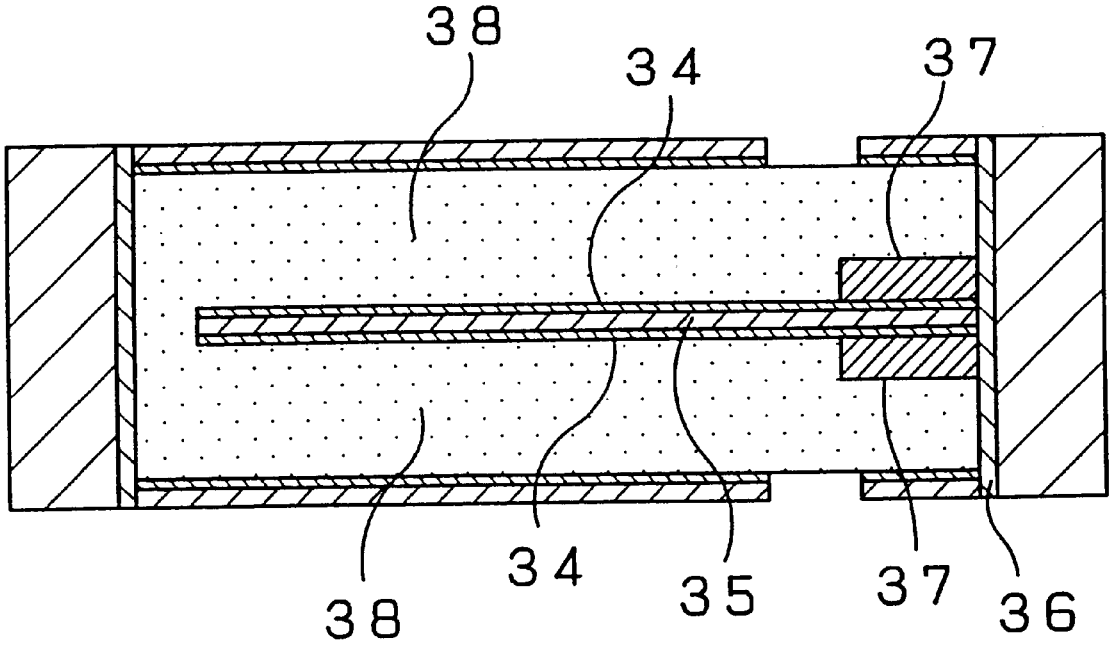
FIG. 5 is a sectional view of a PTC thermistor in another embodiment of the present invention.

Moreover, to enhance the contact between the conductive sheet and metallic foil, as shown in FIG. 5, by forming a junction 37 of about 30 microns by electrolytic copper plating or the like, near the connecting area of the metallic foil as the inner-layer electrode 35 having first plated layers 35 on the upper and lower surfaces, and side-face electrode layers 36, the mechanical strength is increased at the junction 37 with the side-face electrode layers 36. Therefore, to withstand the thermal impulse, both the contact with the conductive sheet 38 and the contact with the side-face electrode layers 36 can be enhanced simultaneously.

In this first embodiment, by forming recesses 19 at sides, the thermal stress caused due to difference in the coefficient of thermal expansion between the conductive sheet 14 and the inner-layer electrode 11 composed of metallic foil is dispersed without being concentrated in the recesses 19, and therefore the degree of effects on the breakage in the junction between the inner-layer electrode 11 composed of metallic foil and the side-face electrode layers 20, and between the outer-layer electrode 18 and side-face electrode layers 20 can be lessened, but the side-face electrode layers 20 may be partially formed without forming recesses 19.

When roughening the surface of the metallic foil as the inner-layer electrode 11 and outer-layer electrode 18, by nickel plating or plate with copper or other metal containing nickel, the surface roughness of the plated layer is greater as compare with the case of other metal. To enhance the contact between the conductive sheet 14 and the inner-layer electrode 11 composed of metallic foil, the surface roughness of 2 microns or more is needed, and to assure such surface roughness, nickel plating capable of obtaining roughness of 2 microns is effective.

Figure 6:
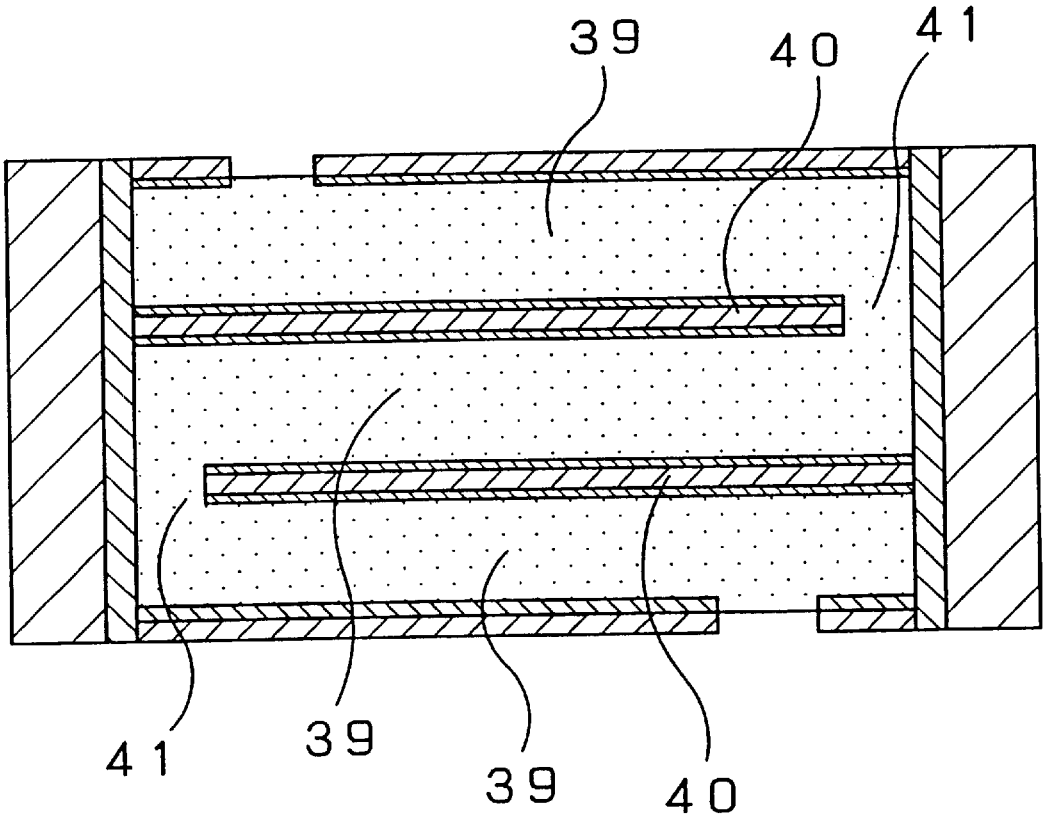
FIG. 6 is a section view of a PTC thermistor in yet another embodiment of the present invention.

In the PTC thermistor in the first embodiment, the conductive sheet 14 is composed of two layers and the inner-layer electrode 11 is composed of one layer of metallic foil, but as shown in FIG. 6, three layers of conductive sheet 39, and two layers of inner-layer electrode 40 composed of metallic foil may be alternately laminated, and layers of larger numbers may be similarly manufactured, and by increasing the number of layers, a PTC thermistor capable of passing a larger current may be manufactured. In such a case, it is necessary to array the inner-layer electrodes 40 so that the free spaces 41 may be aligned alternately at the side ends.

Figure 8:
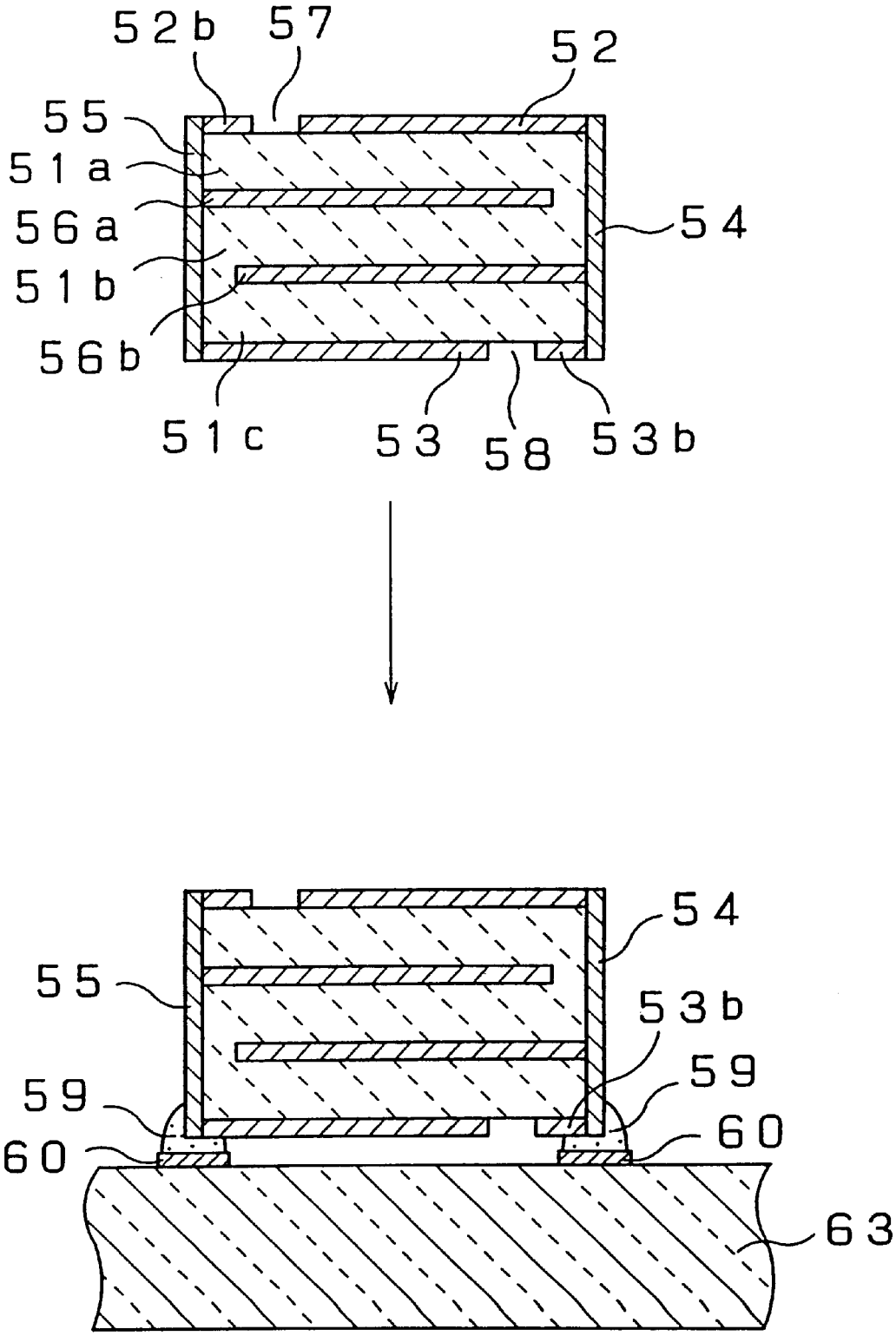
FIG. 8 shows a manufacturing process of a PTC thermistor in an embodiment of the invention, and a process of connecting this PTC thermistor to a wiring board.

Next; a process of mounting the PTC thermistor as shown in FIG. 6 on a printed wiring board is explained by referring to FIG. 8.

First of all, a manufacturing method of PTC thermistor is described. The manufacturing method of this PTC thermistor is nearly same as in the first embodiment. This embodiment refers to a PCT thermistor forming three layers of conductive sheets.

(a) A first conductive sheet 51*a*, a second conductive sheet 51*b*, and a third conductive sheet 51*c* containing organic polymer and having PTC characteristic are supplied.

(b) An electrode material containing a metallic foil is supplied.

(c) The surface of the electrode material is roughened to prepare a first inner-layer electrode 56*a*, a second inner-layer electrode 56*a*, a first outer-layer electrode 52 and a second outer-layer electrode 53 having a roughened surface.

(d) The first outer-layer electrode 52, first conductive sheet 51*a*, first inner-layer electrode 56*a*, second conductive sheet 51*b*, second inner-layer electrode 56*b*, third conductive sheet and second outer-layer electrode 53 are laminated in this sequence.

(e) The laminated body is pressurized from both sides of the first outer-layer electrode 52 and second outer-layer electrode 53, while heating to a temperature over the melting point of the organic polymer.

(f) A first free space 57 is formed in the first outer-layer electrode 52, an electrically separated third outer-layer electrode 52*b* is formed by the first free space 57, a second free space 58 is formed in the second outer-layer electrode 53, and an electrically separated fourth outer-layer electrode 53*b* is formed by the second free space 58.

(g) A first side-face electrode 54 is disposed on a first side face of the laminated body by connecting to the first outer-layer electrode 52, second inner-layer electrode 56*b* and fourth outer-layer electrode 53*b*, and a second side-face electrode 55 is disposed on a second side face of the laminated body by connecting to the second outer-layer electrode 53, third outer-layer electrode 52*b* and first inner-layer electrode 56*a*.

In this procedure, the PTC thermistor was prepared.

In this embodiment, meanwhile, the third outer-layer electrode 52*b* was formed by forming the first free space 57 in the first outer-layer electrode 52, but it is also possible to dispose preliminarily the first outer-layer electrode 52 and third outer-layer electrode 52 on the surface of the first conductive sheet 51*a*. Similarly, instead of forming the fourth outer-layer electrode 53*a* by forming the second free space 58 in the second outer-layer electrode 53, the second outer-layer electrode 53 and fourth outer-layer electrode 53*b* can be preliminarily disposed on the surface of the third conductive sheet 51*c*.

Consequently, a printed wiring board 63 having a specified wiring is supplied. A solder paste 59 is placed at a position of a specified wiring 60 of the printed wiring board. On the applied area of the solder paste 59, the first side-face electrode 54 and second side-face electrode 55 of the PCT thermistor are placed. Then, the solder paste 59 reflows. Thus, the first side-face electrode 54 and second side-face electrode 55 are connected to the wiring 50 of the printed wiring board by soldering.

In the PTC thermistor thus soldered to the printed wiring board, the first side-face electrode 54 and the second side-face electrode 55 respectively maintained the completed connected state to the printed wiring board in the thermal impulse test at high temperature and low temperature.

Figure 7:
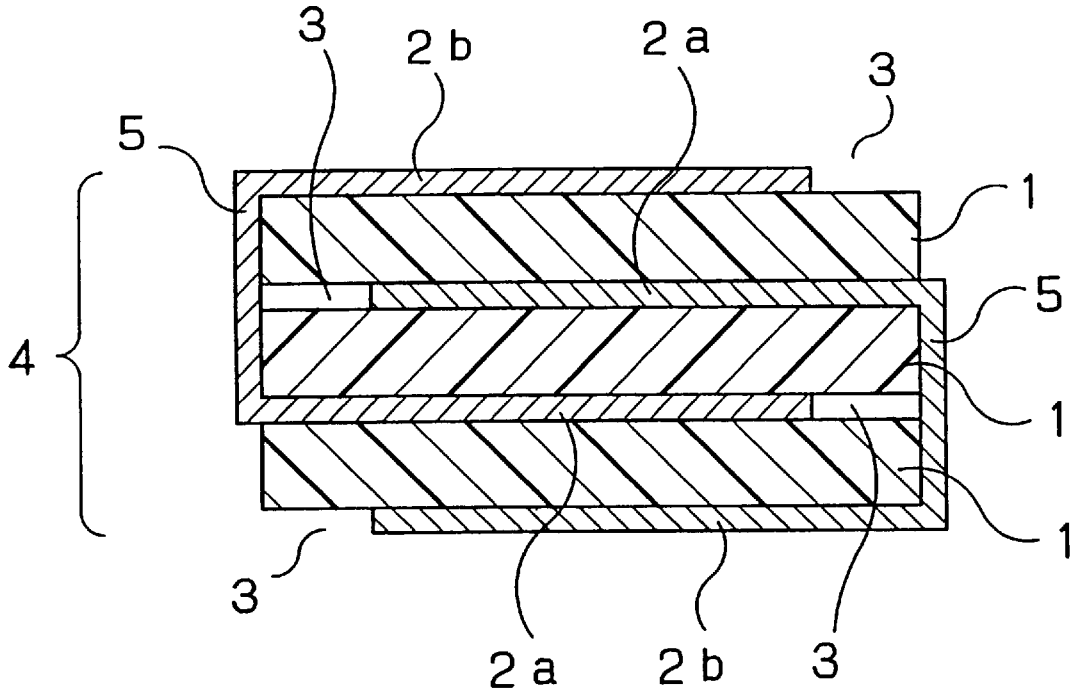
FIG. 7 is a sectional view of a prior art PTC thermistor.
Figure 9:
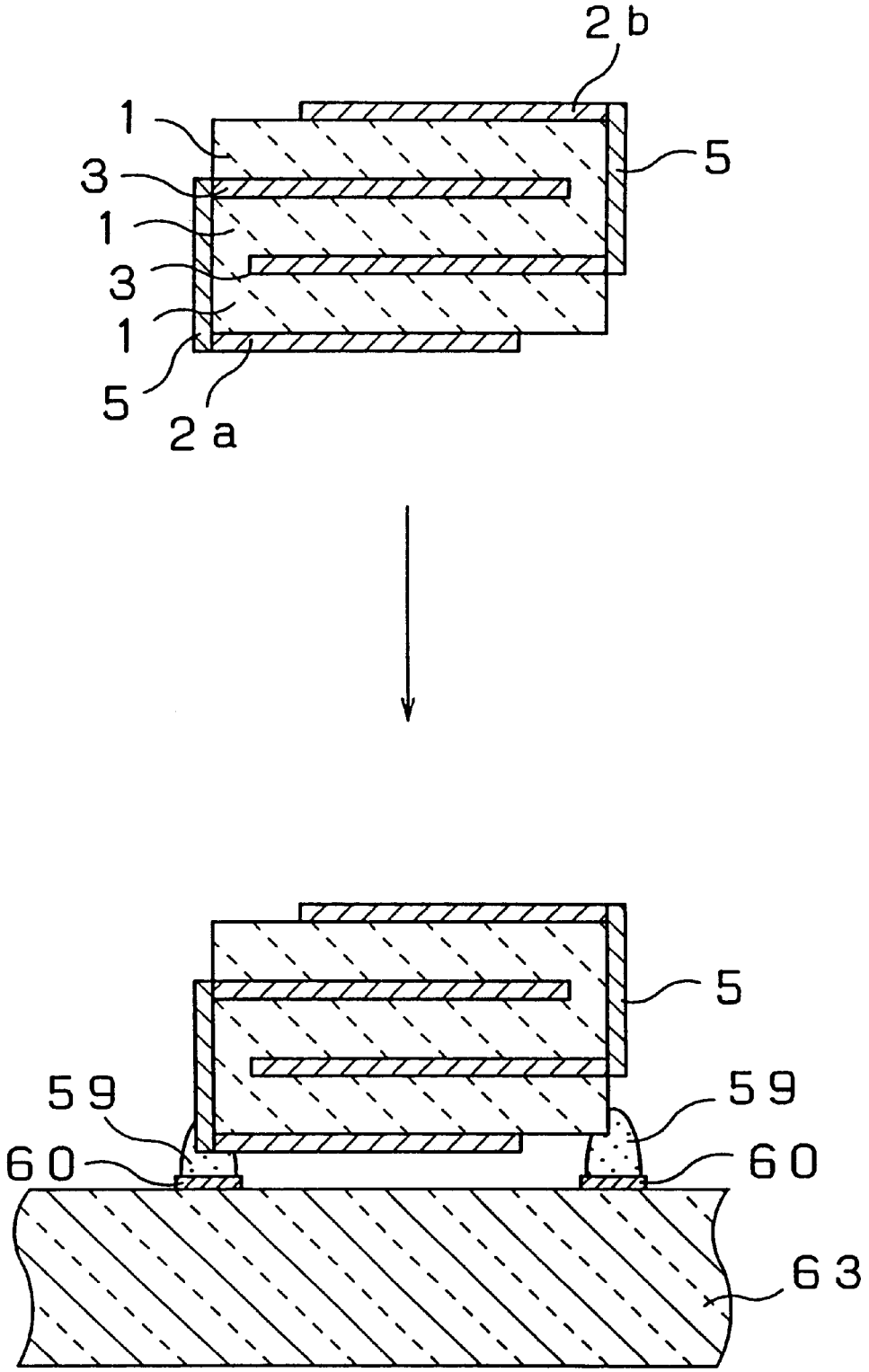
FIG. 9 shows a process of connecting a conventional PTC thermistor to a wiring board.

By contrast, using the conventional PTC thermistor as shown in FIG. 7, the process of connecting by solder paste to the wiring of the printed circuit board in the same method as mentioned above is shown in FIG. 9. In FIG. 9, when the amount of solder paste was insufficient, solder paste 82 As not connected to a first side-face electrode 80, in connection of first side-face electrode 80 and wiring 81. That is, in the embodiment, since the first side-face electrode 54 is extended up to the fourth outer-layer electrode 53*b* installed at the lower side of the third conductive sheet 51*c*, if the amount of solder paste is insufficient, solder paste 59 is completely connected to the fourth outer-layer electrode 53*b*, so that the fourth outer-layer electrode 53*b* and wiring 80 are connected completely by the solder paste 59. As a result, even the event of thermal impulse of high temperature and low temperature, the PTC thermistor and wiring board are connected completely.

INDUSTRIAL APPLICABILITY

As described herein, according to the invention, since the inner-layer electrode and outer-layer electrode are composed of metallic foils having the surface roughened by plating, it provides a PTC thermistor excellent in the contact of the conductive sheet with the inner-layer electrode and outer-electrode composed of metallic foil if exposed to thermal impulse, and having a larger current breaking characteristic.

Reference Numerals

11, 35, 40 Inner-layer electrode
12, 34 First plated layer
13 Laminated body
14, 38, 39 Conductive sheet
15, 41 Free space
16 Second plated layer
17 Free space
18 Outer-layer electrode
19 Recess
20 Side-face electrode layer

What is claimed is:

1. A PTC thermistor comprising:

a laminated body containing at least two layers of conductive sheet composed of a polymer having a PTC characteristic and at least one layer of inner-layer electrode composed of a metallic foil having first plated layers on both surfaces, said laminating body formed by alternately laminating a plurality of layers so that said inner-layer electrode fails to extend to one side end portion and that the outermost layer is said conductive sheet, an outer-layer electrode separated from said inner-layer electrode of said conductive sheet by said conductive sheet, said outer-layer electrode positioned at the outermost layer of said laminated body, having a space in part, and having a second plated layer separating said outer-layer electrode from said conductive sheet, side-face electrode layers disposed only in recesses at sides of said laminated body for connecting electrically said inner-layer electrode and outer-layer electrode.

2. A PTC thermistor of claim 1, wherein the conductive sheet contains three layers or more, and the inner-layer electrode contains two layers or more, and each inner-layer is aligned alternately at side end portions such that none of said inner-layers extend the entire length of distance between said side end portions.

3. A PTC thermistor of claim 1, wherein the inner-layer electrode and outer-layer electrode are nickel-plated copper foils.

4. A PTC thermistor of claim 1, wherein the side-face electrode layers are composed of a same metallic material as the inner-layer electrode and outer-layer electrode.

5. A PTC thermistor comprising:

a conductive sheet having a PTC characteristic, a first outer-layer electrode disposed to a first surface of said conductive sheet, and a third outer-layer electrode disposed on said first surface, being electrically separated from said first outer-layer electrode, a second outer-layer electrode disposed to a second surface of said conductive sheet, and a fourth outer-layer electrode disposed on said second surface, being electrically separated from said second outer-layer electrode, a first side-face electrode layer connected to said first outer-layer electrode and said second outer-layer electrode, disposed at a first side face of said conductive sheet, a second side-face electrode layer connected to said third outer-layer electrode and said fourth outer-layer electrode, disposed at a second side face of said conductive sheet, and an inner-layer electrode having one end connected to said first side-face electrode layer, disposed inside of said conductive sheet between both said first outer-layer electrode and said second outer-layer electrode, and said inner-layer electrode having a metallic foil forming tightening means for increasing the adhesive strength to said conductive sheet, wherein at least one of said first side-face electrode layer and said second side-face electrode layer is disposed at only a portion of said first side face of said conductive sheet and said second side face of said conductive sheet, respectively.

6. A PTC thermistor of claim 5, wherein said inner-layer electrode has a plurality of inner-layer electrodes, and each inner-layer electrode of said plurality of inner-layer electrodes has a first space alternately aligned at said first side face side and said second side face side.

7. A PTC thermistor of claim 5, wherein said metallic foil is a nickel-plated copper foil, and said tightening means includes a roughening of the surface of said metallic foil.

8. A PTC thermistor of claim 5, wherein said first face-side electrode, said first side-face electrode layer, said first outer-layer electrode, said second outer-layer electrode, and said inner-layer electrode are made of the same material as said metallic foil.

9. A PTC thermistor of claim 5, wherein said first side face forms a first recess, said second side face forms a second recess, said first side-face electrode is disposed in said first recess, and said second side-face electrode is disposed in said second recess.

10. A PTC thermistor of claim 5, wherein said inner-layer electrode has a roughened surface with a surface roughness of 2 microns or more, and said roughened surface and said conductive sheet adhere with each other.

11. A PTC thermistor of claim 5, further comprising a junction layer disposed in part of the surface of said inner-layer electrode at the end side connected to said second side-face electrode.

12. A manufacturing method of PTC thermistor comprising the steps of:

supplying an electrode material containing a metallic foil, roughening the surface of said electrode material to form an inner-layer electrode having a roughened surface, laminating a first conductive sheet having a PTC characteristic and containing an organic polymer on a first surface of said inner-layer electrode, and laminating a second conductive sheet having said PTC characteristic and containing said organic polymer on a second surface of said inner-layer electrode, laminating a first outer-layer electrode on the surface of said first conductive sheet, and laminating a second outer-layer electrode on the surface of said second conductive sheet, pressurizing a laminated body containing said first outer-layer electrode, said first conductive sheet, said inner-layer electrode, said second conductive sheet and said second outer-layer electrode, from both sides of said first outer-layer electrode and said second outer-layer electrode, while heating to a temperature over the melting point of said organic polymer, forming a first space in said first outer-layer electrode to form a third outer-layer electrode electrically separated by said space, and forming a second space in said second outer-layer electrode to form a outer-layer electrode electrically separated by said second space, and disposing a second side-face electrode on a first side face of said laminated body by connecting to said first outer-layer electrode and said fourth outer-layer electrode, and disposing a first side-face electrode on a second side face of said laminated body by connecting to said second outer-layer electrode, said third outer-layer electrode and said inner-layer electrode, wherein at least one of said first side-face electrode and said second side-face electrode is disposed at only a portion of said second side face of said laminated body and said first side face of said laminated body, respectively.

13. A manufacturing method of PTC thermistor of claim 12, wherein a surface of said electrode material is roughed to a surface roughness of 2 microns or more.

14. A manufacturing method of PTC thermistor of claim 12, wherein said laminated body is pressurized with a pressure of about 35 $kg/cm^2$ or more, in a state heated to a temperature over the melting point of said organic polymer.

15. A manufacturing method of PTC thermistor of claim 14, wherein said inner-layer electrode having a thickness of 35 microns or more is formed.

16. A manufacturing method of PTC thermistor of claim 12, further comprising a step of disposing a junction layer in part of the surface of said inner-layer electrode at the end side connected to said second side-face electrode.

17. A manufacturing method of PTC thermistor of claim 12, further comprising a step of forming a recess in at least one side face of said first side face and said second side face of said laminated body.

18. A manufacturing method of PTC thermistor of claim 12, wherein a resist is disposed on the surface of at least one outer-layer electrode of said first outer-layer electrode and said second outer-layer electrode, and at least one space of said first space and said second space is formed by chemical etching.

19. A manufacturing method of PTC thermistor of claim 12, wherein said laminated body is formed at said step of laminating a first conductive sheet so that a plurality of inner-layer electrodes containing said inner-layer electrode and a plurality of conductive sheets containing said first conductive sheet and said second conductive sheet are laminated alternately, and each inner-layer electrode of said plural inner-layer electrodes has a third space aligned alternately between the side of said first side face and the side of said second side face.

* * * * *